US009486119B2

(12) United States Patent
Laundre

(10) Patent No.: US 9,486,119 B2
(45) Date of Patent: Nov. 8, 2016

(54) TOILET BUMPER

(71) Applicant: Kohler Co., Kohler, WI (US)

(72) Inventor: Jeffrey Laundre, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 665 days.

(21) Appl. No.: 13/907,453

(22) Filed: May 31, 2013

(65) Prior Publication Data

US 2014/0352046 A1 Dec. 4, 2014

(51) Int. Cl.
*A47K 13/04* (2006.01)

(52) U.S. Cl.
CPC ..... *A47K 13/04* (2013.01); *Y10T 29/49826* (2015.01)

(58) Field of Classification Search
CPC ..... A47K 13/00; A47K 13/02; A47K 13/04; Y10T 16/6285
USPC ..... 4/248, 234, 237; 16/86 A
See application file for complete search history.

(56) References Cited

U.S. PATENT DOCUMENTS

| | | | | | |
|---|---|---|---|---|---|
| 972,820 | A * | 10/1910 | Cleis | A47K 13/04 | 16/86 A |
| 1,190,310 | A * | 7/1916 | Long | A47K 13/04 | 16/86 A |
| 1,206,186 | A | 11/1916 | Whelan | | |
| 1,208,869 | A | 12/1916 | Whelan | | |
| 1,588,019 | A * | 6/1926 | Gitter | A47K 13/00 | 4/237 |
| 2,540,620 | A | 2/1951 | Hyde | | |
| 2,873,454 | A * | 2/1959 | Phillips | A47K 13/04 | 16/42 R |
| 4,178,658 | A * | 12/1979 | Gergonne | E05F 5/06 | 16/86 A |
| 4,318,213 | A | 3/1982 | Blount | | |
| 4,747,167 | A * | 5/1988 | Adams | A47K 13/02 | 4/234 |
| 5,212,840 | A | 5/1993 | Caldwell | | |
| 5,361,425 | A * | 11/1994 | Armanno, Sr. | A47K 13/04 | 16/86 A |
| 7,536,732 | B1 | 5/2009 | Dunlap | | |
| 8,312,571 | B2 | 11/2012 | Vierkant, III et al. | | |
| 2006/0107450 | A1 | 5/2006 | Gildersleeve | | |

FOREIGN PATENT DOCUMENTS

| | | | | |
|---|---|---|---|---|
| CN | 101472513 A | 7/2009 | | |
| DE | 4307039 A1 * | 9/1994 | A47K 13/04 | |
| EP | 0956805 A2 * | 11/1999 | A47K 13/04 | |
| GB | 1 079 014 A | 8/1967 | | |
| JP | 2011-056027 A | 3/2011 | | |

* cited by examiner

*Primary Examiner* — Paul R Durand
*Assistant Examiner* — William R Klotz
(74) *Attorney, Agent, or Firm* — Foley & Lardner LLP

(57) ABSTRACT

A bumper assembly comprising a first member configured to engage a portion of the toilet or bidet attachment; and a resilient second member coupled to the first member; wherein the first member is more rigid than the second member and includes at least one catch configured to selectively engage a recess of the toilet or bidet attachment to detachably couple the first member to the toilet or bidet attachment.

20 Claims, 8 Drawing Sheets

TOILET BUMPER

BACKGROUND

This application relates generally to the field of toilets or bidets having bumpers for attachments thereto, such as seats or lids. More specifically, this application relates to improved bumpers having features that are configured to mechanically lock with the attachment without the use of additional components, as well as having resilient elements that are configured to contact the structures underlying the bumpers.

Toilets and bidets have been configured having movable attachments, such as seats and lids. The movable attachments may be configured having a bumper that is configured to contact an underlying structure (e.g., a rim of toilet, a toilet seat, etc.) when the attachment is in a closed position. Generally, these bumpers are configured as one-piece bumpers made from rubber, and are often press-fit into the attachment. These bumpers then rely on either friction or fasteners (e.g., screws) to retain the bumper to the attachment. This arrangement has several disadvantages, only some of which are disclosed herein. First, these bumpers can be relatively difficult to install, because the friction that helps maintain the coupled bumper and attachment resists installation of the bumper to the attachment. Second, these bumpers have a tendency to spring-back or bounce back after installing it to the attachment, which can cause durability, appearance, and performance issues. Third, these bumpers may become de-coupled from the attachment, unless they include fasteners coupling the bumpers to the attachment, which adds expense in the form of increased part and labor costs.

It would be advantageous to provide a bumper assembly that addresses one or more of the above-identified issues and is relatively simple and efficient to install on a toilet or bidet, such as on a seat or cover thereof.

SUMMARY

One exemplary embodiment relates to a bumper assembly for a toilet or bidet attachment. The bumper assembly includes a first member configured to engage a portion of the toilet or bidet attachment, and a resilient second member coupled to the first member. The first member is more rigid than the second member and includes at least one catch configured to selectively engage a recess of the toilet or bidet attachment to detachably couple the first member to the toilet or bidet attachment.

Another exemplary embodiment relates to an attachment for a toilet or bidet. The attachment includes a base having a pocket and a recess. The attachment also includes a bumper assembly. The bumper assembly includes a first member including at least one catch, and a resilient second member coupled to the first member and including at least one surface that is configured to contact an underlying structure of the toilet or bidet. The first member is more rigid than the second member, and the at least one catch is configured to selectively engage the recess when the first member engages the pocket to secure the bumper assembly to the base.

Yet another exemplary embodiment relates to a method for making an attachment for a toilet or bidet. The method includes forming a bumper assembly including first and second members, where the second member comprises a resilient material and the first member comprises a relatively rigid material compared to the resilient material, the first member including a catch; and inserting the bumper assembly into a pocket of a projection extending from a base until the catch engages a recess provided in an inner wall of the projection to secure the bumper assembly to the projection. The resilient second member is configured to contact a structure of the toilet or bidet underlying the attachment, such that none of the first member, the base, or the projection contacts the underlying structure.

DETAILED DESCRIPTION

Referring generally to the FIGURES, disclosed herein are attachments for toilets, bidets, and the like, which include bumpers (e.g., bumper assemblies) having first and second members. The bumpers disclosed herein are configured for use with any attachment for a toilet or bidet, such as, but not limited to a seat or a cover (e.g., a lid). The second member is resilient and is configured to engage an underlying structure of the toilet, bidet, or attachment. The first member is relatively rigid compared to the resilient second member and includes a locking feature that is configured to engage a mating locking feature of the attachment to detachably couple the bumper assembly to the attachment through a mechanical lock. The mechanical lock of the relatively rigid first member may advantageously be configured to provide a durable, positive engagement between the bumper assembly and the attachment without adding any additional components, such as fasteners to the assembly. The resilient second member of the bumper may advantageously be configured to resist relative lateral movement between the bumper and the attachment and/or cushion the impact between the bumper and the underlying structure (and prevent impact between the attachment and the structure) without inducing spring-back and friction issues.

Figure 1:
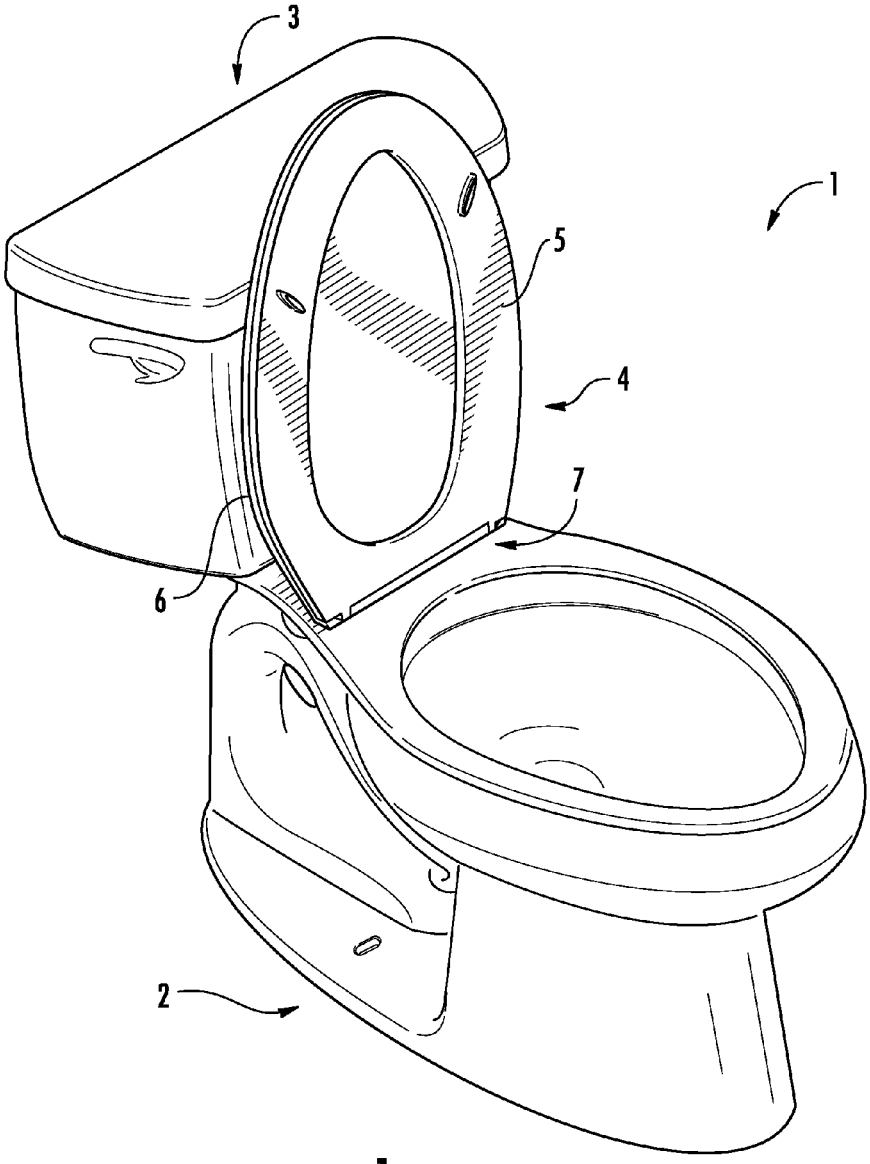
FIG. 1 is a perspective view of a toilet, according to an exemplary embodiment.

FIG. 1 illustrates an exemplary embodiment of a toilet 1 including a pedestal 2 (e.g., base, bowl, etc.), a tank 3 for supplying water to the pedestal 2, and a toilet attachment in the form of a cover and seat assembly 4 movably coupled to the pedestal 2. As shown, the cover and seat assembly 4 includes a toilet seat 5 and a toilet seat cover 6, which are pivotally coupled to a ledge or rim of the pedestal 2 to allow the seat 5 and cover 6 to rotate between an open or up position (as shown in FIG. 1) and a closed or down position (not shown). The cover and seat assembly 4 may include a pivot 7, and the seat 5 and cover 6 may be configured to rotate about the pivot 7. The pivot 7 may also be configured to couple the cover and seat assembly 4 to the pedestal 2, such as through one or more than one fastener.

The toilet 1 may include a bumper assembly that is configured to be disposed between, for example, the rim of the pedestal 2 and the seat 5. Accordingly, when the seat 5 is in the closed position, the bumper assembly may contact both the seat 5 and the rim of the pedestal 2. Thus, the bumper assembly may support the seat 5 on the rim when the seat is closed. Additionally, the bumper assembly may be configured to dampen or cushion the seat 5, such as if the seat 5 falls or is slammed closed and the cover and seat assembly 4 does not include an energy absorbing member, such as a biasing member or spring. Alternatively, the bumper assemblies disclosed herein may be configured to be disposed between, for example, the seat 5 and the cover 6. Thus, when the cover 6 and seat 5 are both in either the open or closed position, the bumper assembly may contact both the cover 6 (e.g., an underside thereof) and the seat 5 (e.g., a topside thereof). It is noted that the bumper assemblies disclosed herein may be configured to be used on the toilet in other applications, such as provided between a toilet tank and a toilet bowl or pedestal, and the examples disclosed are not limiting.

Figure 2:
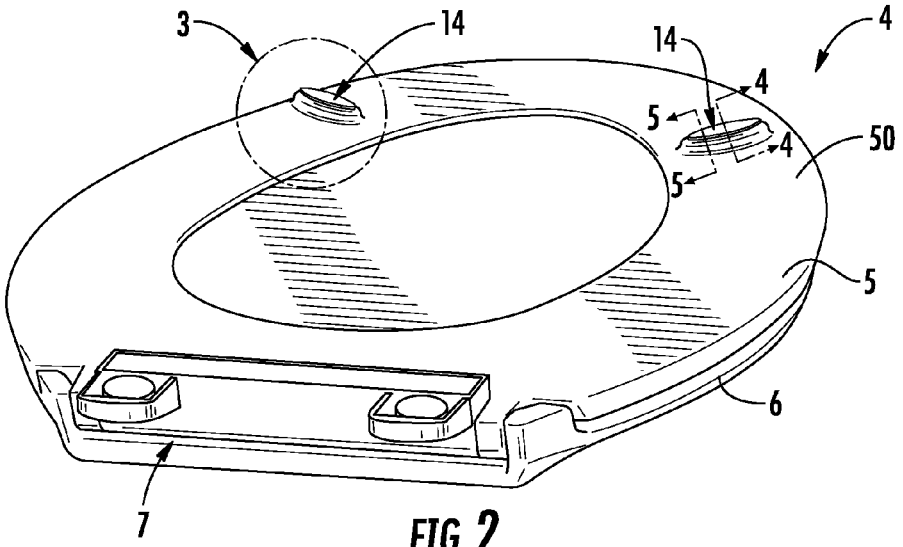
FIG. 2 is a perspective view of an exemplary embodiment of a cover and seat assembly for use with a toilet, such as the toilet shown in FIG. 1.

FIGS. 2-5 illustrate the cover and seat assembly 4 having a bumper assembly 14 coupled to the seat 5. As shown in FIG. 2, the cover and seat assembly 4 includes two bumper assemblies 14 coupled to a front portion of the seat 5 on opposing sides thereof. It is noted that a greater or fewer number of bumper assemblies 14 may be coupled to the seat 5, which may be provided at any location on the seat 5. The seat 5 may be annular shaped or may have any suitable shape. The seat 5 may include a feature disposed on a bottom 50 (e.g., bottom side, bottom surface, etc.) that is configured to receive a bumper assembly 14. As shown, the seat 5 includes two projections 51 extending from the bottom 50, where each projection 51 forms a pocket 52 that is configured to receive a bumper assembly 14 therein. Each projection 51 may have an elongated shape, an oval shape, or any suitable shape, which may be formed by a wall or a plurality of walls.

FIGS. 6-10 illustrate an exemplary embodiment of a bumper assembly 14, which is configured to be coupled to an attachment, such as seat 5 of the cover and seat assembly 4. The bumper assembly 14 may include a first member 10 and a second member 12. According to an exemplary embodiment, the first member 10 is configured as a resilient (e.g., compliant, soft, etc.) member and the second member 12 is configured as a relatively rigid member (e.g., relative to the resilient member), which are configured to be coupled together to form the bumper assembly 14. When the coupled resilient member 10 and rigid member 12 are coupled to an attachment of the toilet (e.g., the projection 51 of the seat 5), the resilient member 10 may be configured to engage an upper surface of an underlying structure (e.g., the top surface of the rim of a pedestal or toilet bowl when the attachment is a toilet seat, or a top surface of a seat when the attachment is a cover or lid provided over the seat), and the rigid member 12 may be configured to engage a recess 53 (e.g., undercut portion, cavity, etc.) of the projection 51 when inserted into the pocket 52 to couple the rigid member 12 to the seat 5.

Figure 3A:
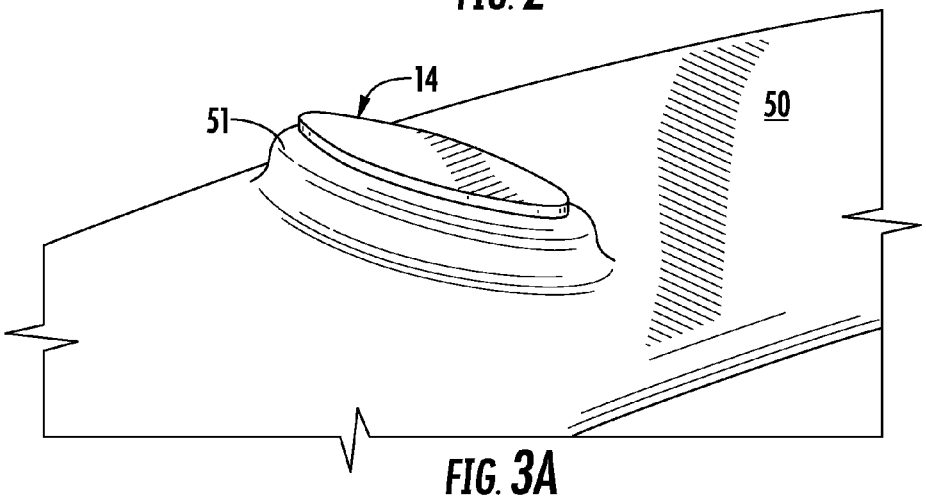
FIG. 3A is a detail view of a portion of the cover and seat assembly of FIG. 2, with a bumper assembly coupled thereto, according to an exemplary embodiment.
Figure 3B:
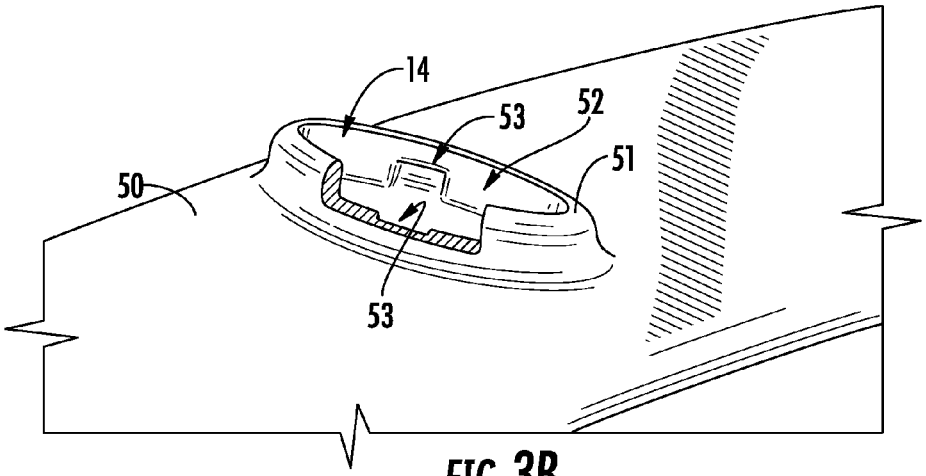
FIG. 3B is a partially cut away detail view of the portion of the cover and seat assembly of FIG. 3A, shown without the bumper assembly.
Figure 4:
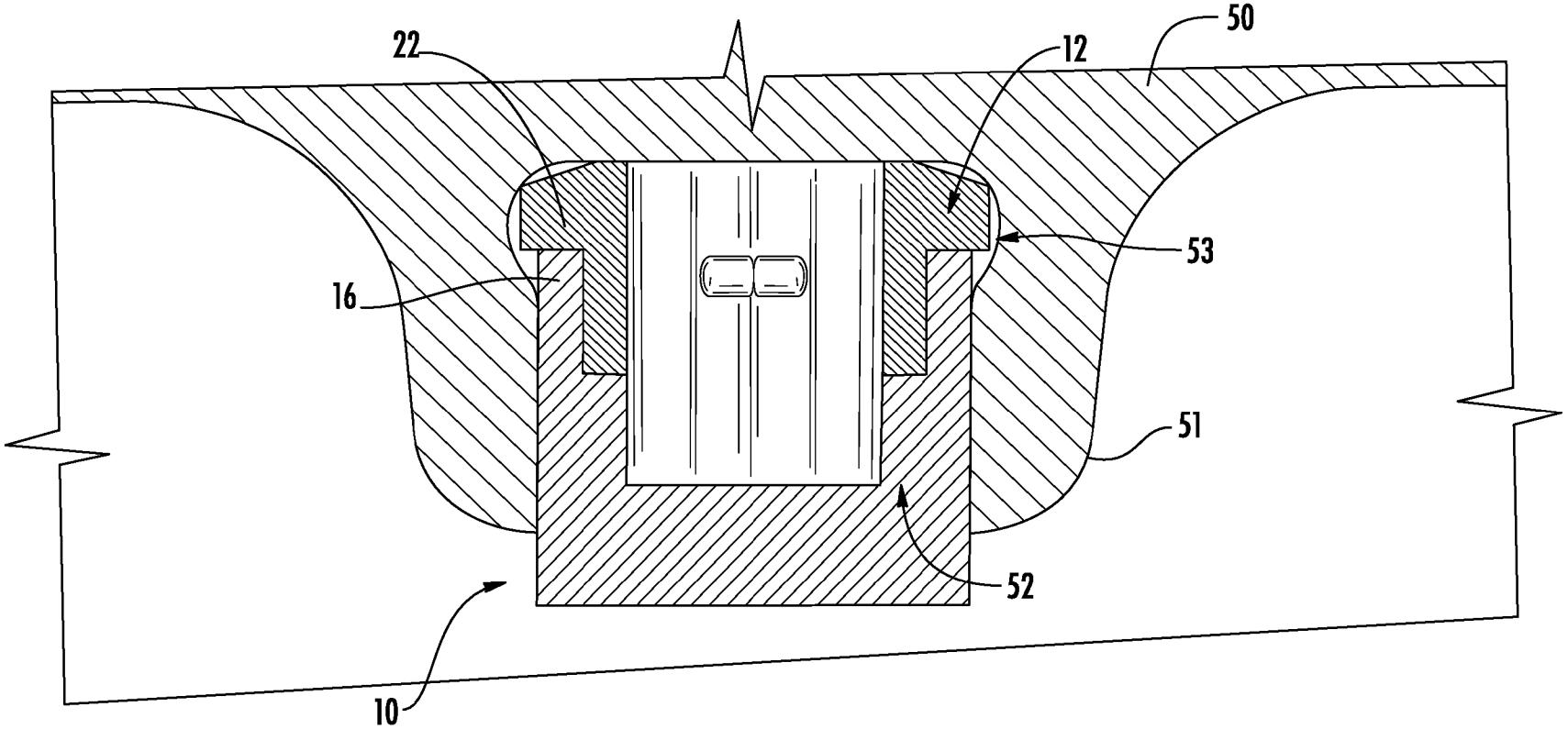
FIG. 4 is a cross-sectional view of the cover and seat assembly of FIG. 2 with an exemplary embodiment of a bumper assembly coupled thereto.
Figure 5:
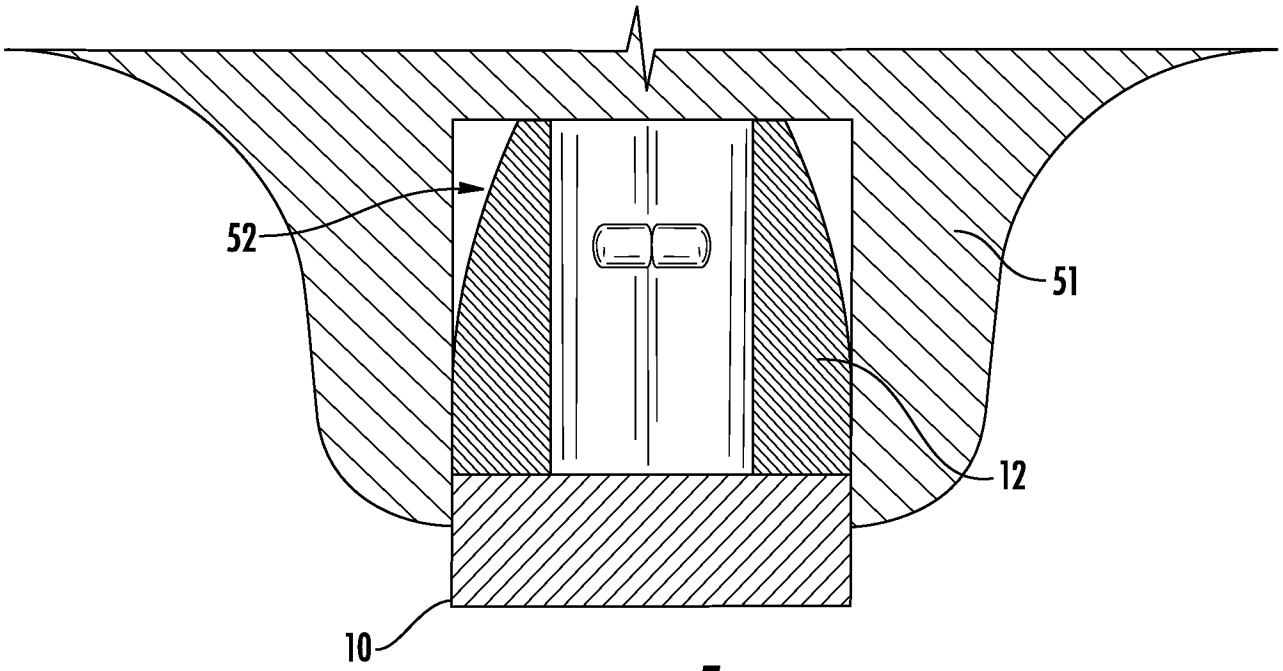
FIG. 5 is another cross-sectional view of the cover and seat assembly of FIG. 2 with the bumper assembly coupled thereto.

As shown in FIGS. 3B and 4, the projection 51 includes a pair of recesses 53 provided on opposing sides of the projection 51. In other words, the projection 51 may include two (or more) recesses 53, with one recess 53 configured on each of two opposing sides of the pocket 52. Each recess 53 is configured to receive a portion of the bumper assembly 14 to couple it to the projection 51. As shown in FIG. 4, the second (e.g., rigid) member 12 includes two catches 22, with one catch 22 arranged on each of the two opposing sides of the second member 12, where each catch 22 engages one recess 53. It is noted that the attachment may include a fewer or greater number of recesses, and the bumper assembly may include a fewer or greater number of catches, and those examples disclosed herein are not limiting.

Figure 8:
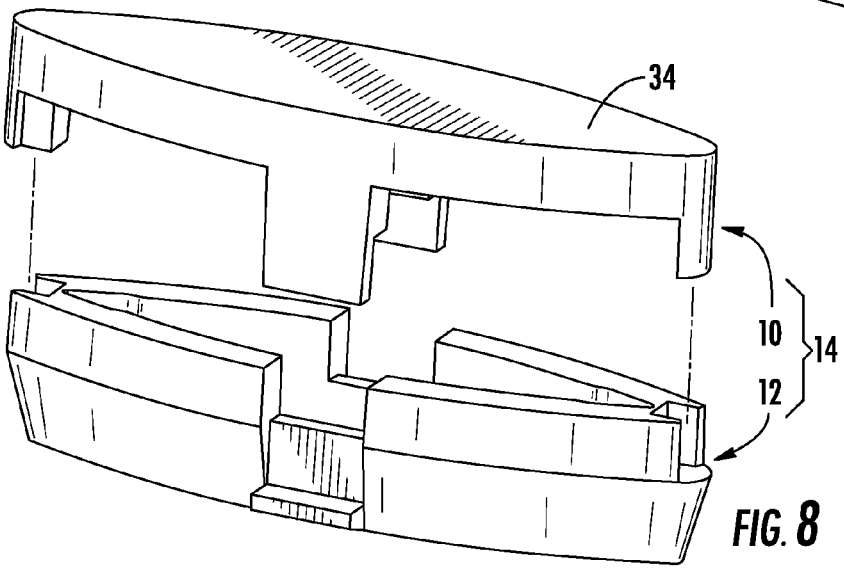
FIG. 8 is an exploded perspective view of the bumper assembly shown in FIG. 6.
Figure 10:
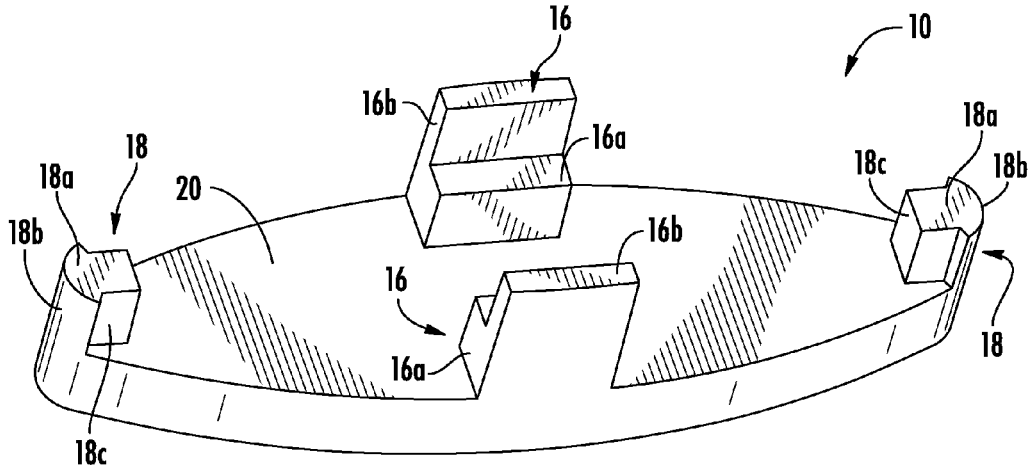
FIG. 10 is a perspective view of a resilient member of the bumper assembly shown in FIG. 6.

FIG. 10 illustrates an exemplary embodiment of a resilient member 10, which is made from a material that is compressible and flexible, such as when subjected to loading (e.g., a force), but is configured to return to its original shape upon release of the loads. For example, the resilient member 10 may be made out of or include an elastic material, such as a thermoplastic elastomer (TPE). Also, for example, the resilient member 10 may be made out of or include a thermoplastic olefin (TPO), silicone (e.g., having anti-microbial properties), a rubber like material (e.g., EPDM, neoprene), or any other suitable material that is resilient. As shown in FIG. 8, the resilient member 10 includes a bottom surface 34, which may be configured to engage an upper surface of the underlying structure, which may be vitreous or another material. The surface adhesion and coefficient of friction properties of the material used for the resilient member 10 may allow the resilient member 10 to resist lateral movement along the upper surface of the underlying structure (e.g., the vitreous rim, the seat, etc.) when the resilient member 10 is engaged with the underlying structure. According to an exemplary embodiment, the material used for the resilient member 10 may have an elasticity of approximately 50-70 durometer. According to a more particular exemplary embodiment, the resilient member 10 may have an elasticity of approximately 60 durometer. While the resilient members (e.g., the resilient member 10) disclosed herein may be formed from the materials provided above (e.g., TPE, TPO, etc.), it is noted that the resilient members may be made from other suitable materials that are resilient and provide the desired properties (e.g., elasticity, adhesion, friction, etc.), and the examples disclosed herein are not limiting. It is also noted that since the underlying structure may be made out of different materials (e.g., vitreous, plastics or polymers, etc.), which may have different properties (e.g., adhesion, friction, etc.), the material of the resilient members may be tailored to accommodate the material of the underlying structure.

As shown in FIGS. 8 and 10, the bottom surface 34 of the resilient member 10 may be generally oval-shaped, and the resilient member 10 may include a top surface 20 opposite the bottom surface 34, which may have a corresponding oval shape. The thickness of the resilient member 10 between the top and bottom surfaces 20, 34 may be tailored for the specific application, and may, for example, be configured to allow a first portion of the thickness to be disposed in the pocket 52 and retained by the projection 51, and a second portion of the thickness to extend beyond the end of the projection 51. Although the FIGURES illustrate resilient members (e.g., the resilient member 10) having particular configurations (e.g., shapes, sizes, etc.), it is noted that the resilient members disclosed herein may be formed having a variety of configurations and those disclosed are not limiting. For example, the shape of the members of the bumper assembly may be tailored to complement the shape of the pocket of the attachment of the toilet or bidet, and the shape of the pocket may have any suitable shape.

The resilient member 10 may include a feature that is configured to couple to the rigid member. As shown in FIG. 10, a portion of the top surface 20 of the resilient member 10 is configured to couple (e.g., engage, interface with, etc.) to a portion of a bottom surface 26 of the rigid member 12. For example, the bottom surface 26 of the rigid member 12 and the top surface 20 of the resilient member 10 may be configured to have generally the same profile. Also, for example, the outer perimeters of the bottom surface 26 and the top surface 20 may be generally symmetrical. Further, the outer perimeters of the members may be configured to complement the shape of the pocket 52 of the seat 5.

In addition, the top surface 20 of the resilient member 10 may include a plurality of protrusions (e.g., projections, members, arms, etc.) that are configured to engage features of the rigid member 12. For example, the rigid member 12 may include a protrusion provided on an end and/or along a side thereof, where the protrusion engages a receiving feature of the rigid member 12. As shown in FIG. 10, the resilient member 10 includes two end protrusions 18 and two side protrusions 16, where the end protrusions 18 and the side protrusions 16 extend outward (e.g., away) from the top surface 20 of the resilient member 10 in a normal direction relative to the top surface 20. The two end protrusions 18 may be provided at opposing ends and the two side protrusions 16 may be provided at opposing sides of the resilient member 10, such that the resilient member 10 has a symmetric configuration (e.g., using a longitudinal plane that extends through midpoints of the end protrusions 18 and/or using a cross-plane that extends through midpoints of the side protrusions 16 and transverse to the longitudinal plane).

The end protrusions 18 of the resilient member 10 may extend away from the top surface 20 a uniform length, such that the end surfaces 18*a* of the end protrusions 18 may be generally planar with each other and/or parallel with the top surface 20. As shown in FIG. 10, each end protrusion 18 includes a first portion 18*b* (e.g., an outer portion) having a semi-cylindrical shape and a second portion 18*c* (e.g., an inner portion) having a hexahedron shape. Accordingly, each end surface 18*a* may include a first portion having a semi-circular shape and a second portion having a rectangular shape. Each second portion 18*c* may be configured to engage a receiving feature of the rigid member 12 that has a complementary shape to the second portion 18*c*.

Each side protrusion 16 of the resilient member 10 may include one or more than one portion, which may extend away from the top surface 20 to a length or different lengths. As shown in FIG. 10, each side protrusion 16 includes a first portion 16*a* (e.g., a base) extending away from the top surface 20 and a second portion 16*b* (e.g., a leg) extending away from the first portion 16*a* (and the top surface 20). Each side protrusion 16 may have generally an L-shaped cross-section where both of the first and second portions 16*a*, 16*b* have hexahedron shapes. The L-shape of the side protrusion 16 may be configured to complement the shape of the mating portion of the rigid member 12. For example, the rigid member 12 may have a generally L-shaped portion that is configured to be opposite to and engaged by the L-shaped side protrusion 16 when the resilient and rigid members 10, 12 are coupled together.

Figure 9:
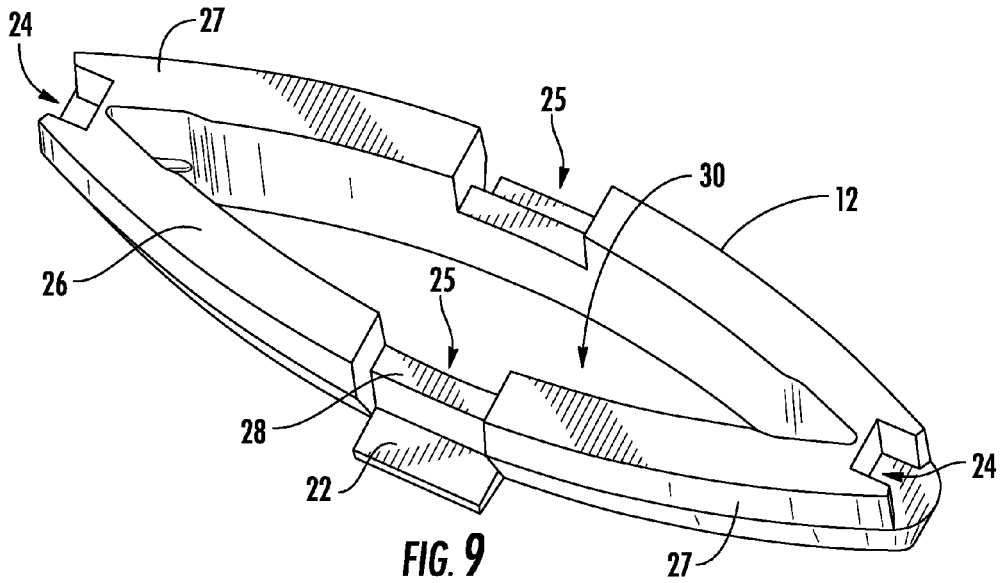
FIG. 9 is a perspective view of a rigid member of the bumper assembly shown in FIG. 6.

FIG. 9 illustrates an exemplary embodiment of the rigid member 12, which may be made from a relatively rigid (e.g., stiff, hard, etc.) polymeric material, such as, for example polypropylene (PP) or polyethylene (PE). For example, the rigid material may be flexible or deformable depending on the geometry, but is not compressible. According to an exemplary embodiment, the material used to form the rigid member 12 is more rigid (e.g., stiffer, harder) than the material used to form the resilient member 10. There are several advantages to using a relatively rigid material for the rigid member 12. First, the surface adhesion properties of a rigid material, such as PP, allow the rigid member 12 to slide into the receiving hole or opening (e.g., the pocket 52) of an attachment (e.g., toilet attachment) with a much lower resistance (e.g., when compared to an elastomeric material). For example, the surface adhesion properties of less rigid or softer materials, such as rubber or TPE, may cause a resilient member to resist installation of the resilient member into the hole (e.g., the pocket 52) of the attachment. Such a soft or resilient member may then undesirably slide or pop out of the pocket 52 of the attachment. Second, a rigid member 12 made out of a relatively rigid material may be formed with a mechanical feature that is configured to have a strong, positive engagement with one or more features of the attachment. For example, the rigid member 12 may include one or more catches 22 that are configured to positively engage the recesses 53 of the projection 51 of the seat 5 in order to couple the bumper assembly 14 to the seat 5.

Figure 7:
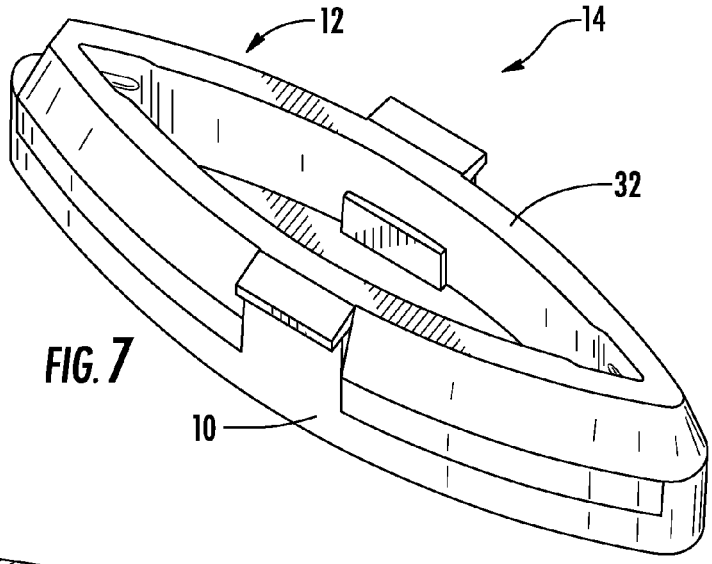
FIG. 7 is another perspective view of the bumper assembly shown in FIG. 6.

Referring to FIGS. 7 and 9, according to an exemplary embodiment, the rigid member 12 may include a body that is substantially oval-shaped, and may include the top surface 32, which is opposite the bottom surface 26. In addition, the body of the rigid member 12 may include a hollow portion 30 provided between the bottom surface 26 and the top surface 32. The rigid member 12 may include a side wall 27 disposed on either side of the hollow portion 30, where the side walls 27 extend between and are interconnected at two ends (e.g., longitudinal ends) of the rigid member 12. Each side wall 27 includes an outer surface, which may have an arcuate shape, that defines an outer radial surface of the rigid member 12.

According to an exemplary embodiment, the rigid member 12 may be configured to allow the two side walls 27 to deflect (e.g., deform elastically) when subjected to compression loading. For example, the size (e.g., a thickness as measured between an inner surface adjacent the hollow portion 30 and the outer radial surface of the rigid member 12) of the side walls 27 may be designed having a particular load to deflection characteristic to allow the side walls 27 to be moved closer together during compression loading, such as to allow insertion of the bumper assembly 14 into the pocket 52 of the seat 5. In other words the force that is required to elastically deform the side walls 27 may be tailored, such as to allow a person to insert the bumper assembly 14 into the pocket 52 by hand (and without the use of tools). The load to deflection characteristic of the rigid member 12 (e.g., of its side walls 27) may be influenced by other parameters, such as, for example, the length of the side walls 27 (e.g., the distance between the ends of the rigid member 12), the properties (e.g., strength, modulus, etc.) of the material selected, the size of the hollow portion 30 between the side walls 27. Accordingly, it is noted that one or any combination of these parameters may be tailored to the specific configuration of the toilet or bidet. For example, the thicknesses of the side walls may be different for rigid members formed of different materials.

Each side wall 27 of the rigid member 12 may have a uniform thickness or a non-uniform thickness. For example, each side wall 27 may be configured to transition (e.g., narrow) in thickness proximate the two ends, such that the portion of each side wall 27 near each end is narrower than an adjacent portion of the side wall 27. Also, for example, each side wall 27 may include a receiving portion 28 that has a reduced thickness relative to an adjacent portion of the side wall 27, where the receiving portion 28 is configured to receive a portion of the resilient member 10 (e.g., the L-shaped protrusion 16). In other words, each side wall 27 may include a first section (e.g., proximate the end) having a first thickness, a second section (e.g., receiving portion 28, middle portion, etc.) having a second thickness, and a third section provided between the first and second sections having a third thickness. As shown in FIG. 9, the first thickness is greater than the second thickness, and the third thickness is greater than the first thickness. Each transition of the side walls 27 of the rigid member 12 may provide a "break point" at which the side walls may flex inwards. In other words, the locations of the transition(s) and the thickness(es) of the section(s) of the side walls 27 may be configured to tailor the locations and amounts of deflection of the rigid member 12. Accordingly, it is noted that while the particular rigid members disclosed herein include side walls of particular configurations (e.g., shapes, thicknesses, etc.), other exemplary embodiments of rigid members may be configured having different configurations, which may be configured to provide different load-deflection characteristics, and the exemplary embodiments disclosed herein are not limiting.

Referring still to FIG. 9, according to an exemplary embodiment, the rigid member 12 includes at least one recess that is configured to receive a portion of the resilient member 10. For example, the bottom surface 26 of the rigid member 12 may include a plurality of recesses (e.g., cavities, depressions, slots, pockets, etc.), such as two end recesses 24 and two side recesses 25. The end recesses 24 may be configured to receive a corresponding end protrusion 18 of the resilient member 10, and the side recesses 25 may be configured to receive a corresponding side protrusion 16 of the resilient member 10.

As shown in FIG. 9, the two end recesses 24 may be formed on two opposing ends (e.g., longitudinal ends) of the rigid member 12, and may have a hexahedron shape or any other suitable shape that complements the end protrusions 18. The end recesses 24 may extend a height that is equal to approximately half the distance between the bottom surface 26 and the top surface 32. Further, the heights of the end recesses 24 may be configured to correspond to the height of the end protrusions 18 of the resilient member 10 (e.g., the distance from the top surface 20 to the end surfaces 18*a*). Each end recess 24 may extend a depth that is short of the hollow portion 30, where a wall is provided between the hollow portion 30 and the end recess 24, as shown in FIG. 9.

Figure 11:
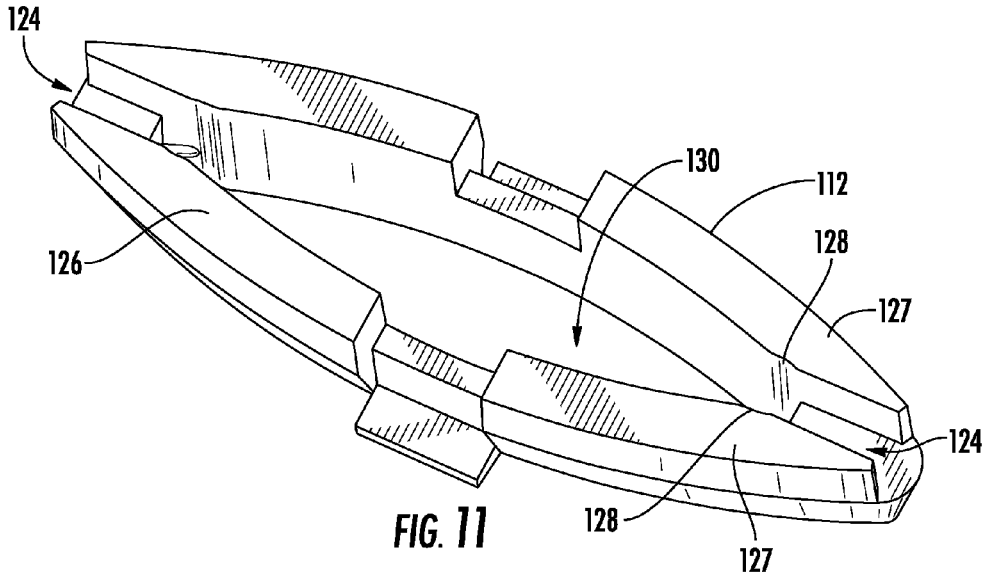
FIG. 11 is a perspective view of a rigid member of a bumper assembly, according to another exemplary embodiment.
Figure 12:
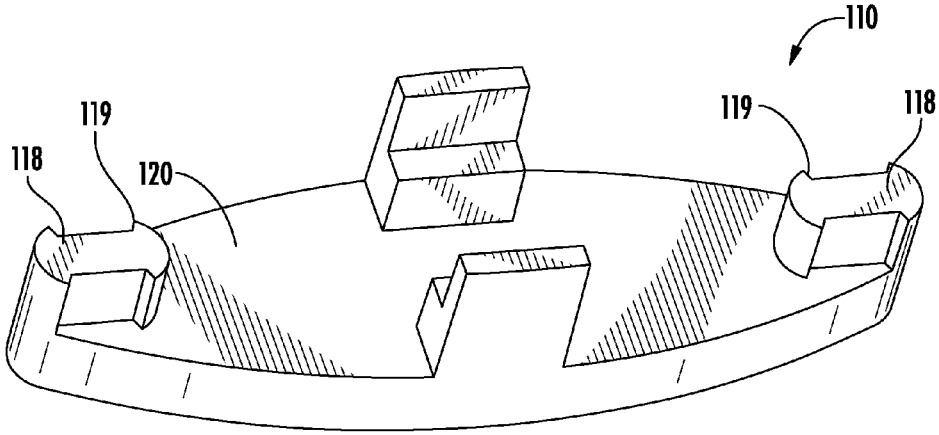
FIG. 12 is a perspective view of a resilient member of a bumper assembly, according to another exemplary embodiment.

Alternatively, the rigid member 12 may include an end recess configured to extend a different depth than the end recess 24. FIG. 11 illustrates another exemplary embodiment of a rigid member 112 that includes two opposing end recesses 124 that extend through to a hollow portion 130 disposed between the two side walls 127. In other words, each recess 124 may extend completely through the ends of the side walls 127, such that there is not a webbing or bridge interconnecting the side walls at the respective end. Each recess 124 may extend to a bottom surface 126 of the rigid member 112. Further, each side wall 127 may include a transition 128 that is configured to receive a portion of the resilient member 110 therein. As shown, each transition 128 is in the form of a semi-circular shaped notch that extends in a direction that is transverse to the bottom surface 126 along an inner surface of the respective side wall. However, each transition 128 may have a different shape, such as triangular, a combination of semi-circular and triangular, or any suitable shape, which may complement the shape of the portion of the resilient member 110 that engages the transition 128. FIG. 12 illustrates another exemplary embodiment of a resilient member 110 that includes end protrusions 118 configured to engage the end recesses 124 of the rigid member 112. Each end protrusion 118 may include first and/or second portions, which may be similar to, the same as, or different than those portions disclosed for the resilient member 10. Each end protrusion 118 may include a portion 119 (e.g., a third portion, if the member includes first and second portions) that is configured to engage at least one transition 128. As shown, each end protrusion 118 includes a portion 119 that is configured to engage both transitions 128 disposed at one of the two ends of the rigid member 112. Each portion 119 may include a finger extending from both sides, such that each finger engages one transition 128. Each finger of the portion 119 may have a shape (e.g., semi-circular, triangular, rectangular, combination thereof, etc.) that is configured to complement the shape of the transition 128.

Referring back to FIGS. 9 and 10, a portion of the area defined by the end recesses 24 may extend between the outer radial surface of the rigid member 12 and the hollow portion 30. Accordingly, a portion of each end protrusion 18 of the resilient member 10 may be configured to couple to the hollow portion 30 of the rigid member 12.

According to an exemplary embodiment, each side recess 25 may be provided in one of the side walls 27 of the rigid member 12, such as, for example, where one side recess 25 is located approximately halfway between the two end recesses 24 on each side wall 27. Further, the two side recesses 25 may include multiple portions, each of which may extend downward from the bottom surface 26 to different heights. For example, each side recess 25 may include a first recessed portion positioned radially outward from the hollow portion 30, where the first recessed portion has a height that is approximately halfway between the top surface 32 and the bottom surface 26 of the rigid member 12. The size of the first recessed portion of each side recess 25 may be configured to correspond to the size of a portion of each side protrusion 16 of the resilient member 10. For example, the height of the first recessed portion may correspond to the height of the first portion 16*a* of the side protrusion 16. The first recessed portion may extend a depth through the side wall 27.

Each side recess 25 of the rigid member 12 may include a second recessed portion, which may be positioned radially outward from the first recessed portion. The size of the second recessed portion may correspond to the size of a portion of each side protrusion 16 of the resilient member 10. For example, the height of the second recessed portion may correspond to the combined heights of the first and second portions 16*a*, 16*b*, and the depth of the second recessed portion may correspond to the depth of the second portion 16*b* of the side protrusion 16. Thus, the height of the second recessed portion may be equal to the distance from a catch 22 to the bottom surface 26 of the rigid member 12. In other words, the height of each of the second recessed portions of the side recesses 25 may be slightly less than the height of the rigid member 12.

Referring to FIGS. 7 and 9, the rigid member 12 may include a catch 22 (e.g., latch, member, flange, projection, ear, tab, arm, etc.). As shown, the rigid member 12 includes two catches 22, with one catch 22 provided on each side of the rigid member 12. For example, each catch 22 may extend outwardly from the receiving portion 28 and/or the side wall 27. In other words, the catches 22 may extend laterally outwards from a radial surface of the rigid member 12. Also, the rigid member 12 may be configured to flex (e.g., deflect, deform, etc.) so that the catches 22 move inward toward one another, such as to allow the bumper assembly 14 to be inserted into the attachment (e.g., the pocket 52) and allow the catches 22 to engage the receiving feature of the attachment (e.g., the recesses 53 of the seat 5) to couple the bumper assembly 14 to the attachment. For example, the position of the catches 22 may be approximately halfway between the two end recesses 24 (e.g., at the midpoint of the length of the side wall 27), and this halfway position of the side walls of the rigid member 12 may be configured to experience the greatest elastic deformation. Each catch 22 may extend outward a distance that allows the catch 22 to engage the recesses 53 when the resilient member 10 is in the pocket 52.

As shown in FIG. 4, the catch 22 of the rigid member 12 includes an angled surface that serves as the leading surface (i.e., it is the surface that leads the rigid member 12 into the pocket when the bumper assembly 14 is inserted therein). The angled surface may make it easier to insert the bumper assembly 14 into the pocket 52. The catch 22 may also include a trailing surface that is generally parallel to the top surface 32. The trailing surface may help retain the rigid member 12 into the pocket by having a sharp edge that engages the recess 53. Also, the catches 22 may be integrally formed with the rigid member 12, proximate the top surface 32. It is noted that the configuration (e.g., shape, size, etc.) of each catch 22 may be different than those examples disclosed herein, and the disclosed examples are not limiting.

According to an exemplary embodiment, the materials used for the resilient member 10 and the rigid member 12 may be configured to chemically bond with each other. For example, the rigid member 12 may be formed from PP, and the resilient member 10 may be formed from a TPE, it should be understood that other materials (e.g., another polymeric material, composite material, or any other suitable material) may be used to make either the rigid member or the resilient member of the bumper assembly disclosed herein, according to other exemplary embodiments.

Figure 6:
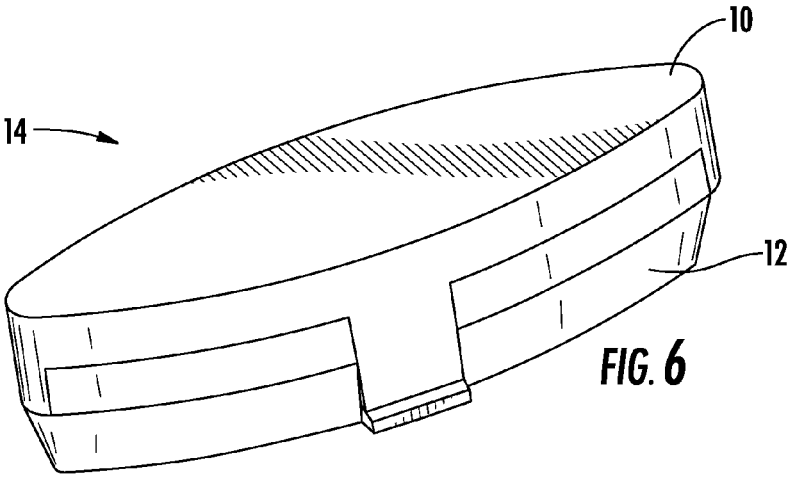
FIG. 6 is a perspective view of an exemplary embodiment of a bumper assembly configured for use with an attachment, such as the cover and seat assembly shown in FIG. 2.

Referring now to FIGS. 6-8, according to an exemplary embodiment, the resilient member 10 is configured to be coupled to the rigid member 12 in order to form the bumper assembly 14. For example, when the resilient member 10 is coupled to the rigid member 12, the end protrusions 18 of the resilient member 10 may be configured to be received within the end recesses 24 of the rigid member 12 (as shown in FIGS. 9 and 10), and the height of the end protrusions 18 may correspond to the depth of the end recesses 24. In addition, the side protrusions 16 may be configured to be received within the side recesses 25. Also, the height of the side protrusions 16 may correspond to the depth of the side recesses 25. According to an exemplary embodiment, a portion of the side protrusions 16 may be coupled to the catches 22 when the resilient member 10 is coupled to the rigid member 12.

According to various exemplary embodiments, several processes may be used to couple the resilient member 10 to the rigid member 12. For example, according to an exemplary embodiment, a two-shot molding process may be used to couple the resilient member 10 to the rigid member 12 (e.g., plastic is injected into a mold to form the rigid member, the mold is rotated, and TPE is injected into the mold to form the resilient member to the rigid member). According to another exemplary embodiment, an insert molding process may be used in which the rigid member is molded in a separate process, then placed in another mold where the resilient member may be molded or overmolded around it. While various processes have been described in which a rigid member and a resilient member of a bumper assembly may be formed and coupled together, it is noted that the resilient and rigid members of the bumper assemblies disclosed herein may be formed and coupled together in other ways (e.g., through mechanical features, press-fit together, using an adhesive, through surface adhesion, etc.) according to other exemplary embodiments.

Figure 13:
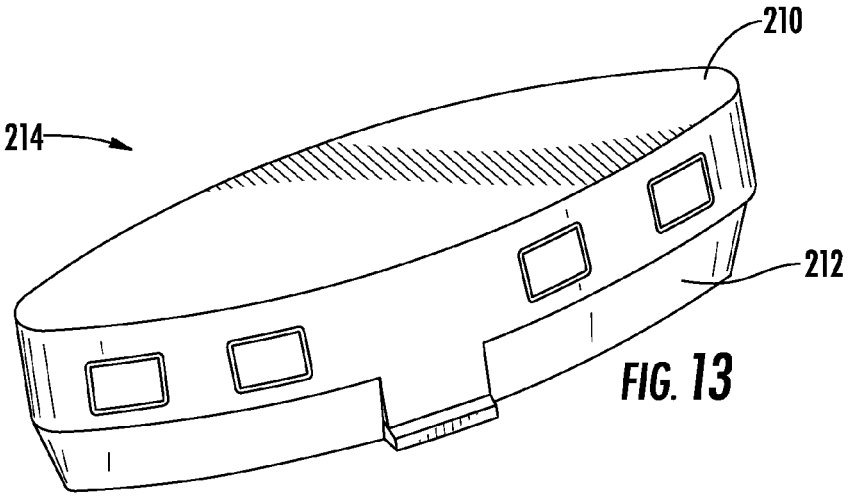
FIG. 13 is a perspective view of another exemplary embodiment of a bumper assembly configured for use with an attachment, such as the cover and seat assembly shown in FIG. 2.
Figure 14:
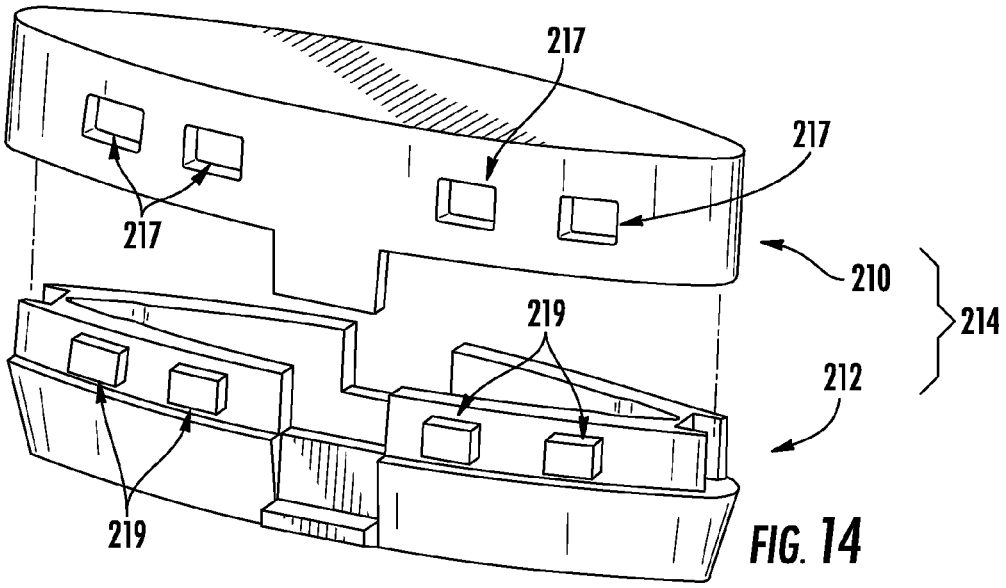
FIG. 14 is an exploded perspective view of the bumper assembly shown in FIG. 13.

According to an exemplary embodiment, the resilient member 10 may be coupled to the rigid member 12 through use of mechanical features. For example, one of the rigid member and the resilient member may include a projection (e.g., extension, protrusion, member, hook, flange, etc.) that is configured to engage a pocket (e.g., hole, slot, opening, etc.) in the other of the rigid member and the resilient member. FIGS. 13 and 14 illustrate a bumper assembly 214 including a rigid member 212 and a resilient member 210 that are coupled together through a plurality of projections 219 and a plurality of pockets 217. The plurality of projections 219 of the rigid member 212 are configured having a generally hexagonal shape, and are configured to extend from an outer surface of a portion of the rigid member 212. The plurality of pockets 217 of the resilient member 210 are configured having a complementary shape to the projections 219 in order for each pocket 217 to receive a projection 219 therein when the rigid and resilient members are coupled together. It is noted that the configurations (e.g., shape, size) may be different than hexagonal, such as circular, oval, or suitable shape.

Also, for example, the rigid member (e.g., the rigid member 12, 112, 212) may include at least one pocket (e.g., disposed in each side wall), and the resilient member (e.g., the resilient member 10, 110 210) may include at least one projection configured to be received by the at least one pocket. Accordingly, the rigid and resilient members may be coupled together through a mechanical lock to form the bumper assembly. The mechanical lock may advantageously provide for an improved connection between the members and/or may allow the members to be made using materials that do not necessarily need to chemically bond to one another.

According to an exemplary embodiment, a plurality of bumper assemblies 14, 114, 214 may be configured to provide a uniform gap between the bottom surface of the toilet attachment and an upper surface of an underlying structure (e.g., a toilet, a bidet, etc.), when the toilet attachment is in a lowered position. Likewise, the bumper assemblies 14, 114, 214 may be configured to provide a uniform gap between two separate toilet attachments (e.g., a seat and a lid or cover) when the toilet attachments are in lowered positions. For example, the bumper assemblies 14, 114, 214, having rigid members 12, 112, 212 made from a rigid material, may undergo less elastic deformation than a one-part bumper assembly that is completely formed from an elastomeric material. Also, the bumper assemblies 14, 114, 214 may undergo less deformation (plastic and/or elastic deformation) over long periods of use than a one-part bumper assembly. Therefore, compared to a one-part bumper assembly, the two-part bumper assemblies 14, 114, 214 may be configured to provide a gap between an attachment and a toilet or bidet which remains more consistent (e.g., uniform) after long periods of use.

According to an exemplary embodiment, the bumper assemblies 14, 114, 214 may be configured to absorb energy from the impact between an attachment and a toilet bowl, bidet, or between two attachments. As a result, the sound from an impact between, for example, a toilet attachment and a toilet bowl may be desirably reduced. Also, the stress of such impacts to other areas of the attachment and/or the toilet or bidet may be desirably reduced. In contrast, a bumper that is made completely from a hard, rigid material may not be designed to absorb energy from the impact of an attachment and a toilet bowl or bidet.

According to an exemplary embodiment, an attachment (e.g., a toilet attachment, a bidet attachment, etc.) may be configured to receive the bumper assembly 14, 114, 214. For example, a plurality of projections (e.g., the projections 51) may be formed on a surface (e.g., the bottom 50) of the attachment by molding the attachment around a tool configured to form the projections. As discussed, each projection 51 may include a pocket 52 disposed therein. The pockets 52 may be formed proximate a forward end, on either side of the toilet attachment, when the toilet attachment is assembled to a toilet. The perimeter of each pocket 52 may be configured to correspond to the perimeter of the bumper assembly 14, 114, 214. In addition, each projection 51 may include a recess 53 or a plurality of recesses 53 (e.g., groove, slot, undercuts, etc.), which may be positioned, for example, approximately halfway between two longitudinal ends of the projection 51, such as with one recess 53 on either side of the projection 51, and near the base (e.g., bottom) of the pocket 52.

According to an exemplary embodiment, the projection 51 having a pocket 52 and a recess 53 may be formed by removing a tool from the attachment, before the toilet attachment has fully cured (e.g., hardened, set, cooled, etc.). The tool may include a base that forms the pocket 52 and a flange (e.g., lip, protrusion, etc.) configured to form the recess 53 when the tool is removed from the attachment. It should be understood that while one method to form a the projection having a pocket and a recess has been described, according to an exemplary embodiment, other methods may be used to form the projection having a pocket and a recess. For example, according to another exemplary embodiment, the recess 53 of the projection 51 may be formed by using a collapsible tool. Such a collapsible tool may have a flange which collapses inward before the tool is removed from the attachment. According to another exemplary embodiment, a secondary process or post process (e.g., machining process) may be used to form the pocket 52 and/or the recess 53 of the attachment.

According to an exemplary embodiment, the bumper assembly 14 may be assembled to a toilet attachment by inserting the rigid member 12 into the pocket 52. For example, the bumper assembly 14 may be oriented so the rigid member 12 is faced toward the pocket 52. Next, the rigid member 12 may be pressed into the pocket 52. As the rigid member 12 is pressed into the pocket 52, the sides of the rigid member 12 and/or the catches 22 may flex inward to reduce the width of the rigid member 12 in order to allow the bumper assembly 14 to fit within the pocket 52 of the toilet attachment. Each recess 53 in the projection 51 of the attachment may be undercut from an adjacent inner surface of the projection, where the rigid member 12 is deformable to allow the catches 22 to deflect from a first offset distance that is greater than a spacing between two opposing adjacent inner surfaces of the projection 51 to a second offset distance that is less than or equal to the spacing to allow the rigid member 12 to fit into the pocket 52. Once the catches 22 become aligned with the recesses 53 in the projection 51, the catches may flex outward into the recesses 53 to secure (e.g., retain, hold, lock, etc.) the bumper assembly 14 within the toilet attachment. Thus, the catch of the bumper assembly 14 may provide a mechanical that couples the bumper assembly to the toilet attachment. It is noted that where a "toilet attachment" is specifically referred to, any attachment for a toilet or bidet is contemplated, and the particular example is not limiting.

Advantageously, the two-part bumper assembly 14, 114, 214 may be retained by a toilet attachment through the use of integrally formed mechanical features, such as the catches 22. One skilled in the art will readily appreciate the bumper assemblies provided in the various exemplary embodiments of this disclosure may not require the use of fasteners to retain the bumper assembly within the pocket and/or projection of the attachment. As a result, it may be easier for a person to assemble the bumper assembly 14, 114, 214 to the attachment. In addition, a person skilled in the art will appreciate that relatively inexpensive materials, such as polymeric and/or elastomeric materials, may be used to manufacture a bumper assembly provided in the various exemplary embodiments of this disclosure.

As utilized herein, the terms "approximately," "about," "substantially," "essentially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the attachments having bumper assemblies as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, manufacturing processes, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. A bumper assembly for a toilet or bidet attachment, the bumper assembly comprising:

a first member configured to engage a pocket in a projection of a seat or a lid of the toilet or bidet attachment; and a resilient second member coupled to the first member and configured to engage the pocket in the projection of the seat or the lid;

wherein the first member is more rigid than the second member and includes a first catch configured to selectively engage a first recess of the projection and a second catch configured to selectively engage a second recess of the projection to detachably couple the first member to the seat or the lid; and wherein the first catch extends in a first direction and the second catch extends in a second direction that is different than the first direction.

2. The bumper assembly of claim 1, wherein the second member comprises an elastomeric material, and the first member comprises a relatively rigid material that is not an elastomeric material.

3. The bumper assembly of claim 1, wherein the first direction and the second direction are generally opposite directions, and wherein the first recess generally opposes the second recess.

4. The bumper assembly of claim 3, wherein each recess of the first recess and the second recess of the projection is an undercut from an adjacent inner surface of the projection, and wherein the first member is deformable to allow the at least two catches to deflect from a first offset distance that is greater than a spacing between two opposing adjacent inner surfaces defining the pocket of the seat or the lid to a second offset distance that is less than or equal to the spacing to allow the first member to fit into the pocket of the projection.

5. The bumper assembly of claim 4, wherein the projection is configured to extend away from a bottom of the seat or the lid, wherein the first catch extends from a first side wall of the first member and the second catch extends from a second side wall of the first member, and wherein the first member includes a hollow portion provided between the first and second side walls to allow the first and second side walls to deform toward one another to change the offset distance between the first and second catches.

6. The bumper assembly of claim 5, wherein the first member includes a recess configured to receive at least a portion of the second member.

7. The bumper assembly of claim 6, wherein the first member includes two end recesses, and the second member includes two end protrusions configured to engage the two end recesses.

8. The bumper assembly of claim 7, wherein the two end recesses extend into the hollow portion of the first member.

9. The bumper assembly of claim 7, wherein the first member also includes two side recesses, and the second member includes two side protrusions configured to engage the two side recesses.

10. An attachment for a toilet or bidet, the attachment comprising:

a seat or a lid having a projection, wherein an inner wall of the projection defines a pocket and at least one recess that is undercut from the inner wall; and a bumper assembly comprising:

a first member engaging the pocket and including at least one catch; and a resilient second member coupled to the first member and engaging the pocket, the second member including at least one surface that is configured to contact an underlying structure of the toilet or bidet;

wherein the first member is more rigid than the second member; and wherein the at least one catch is configured to selectively engage the at least one recess when the first member engages the pocket to secure the bumper assembly to the seat or the lid.

11. The toilet or bidet attachment of claim 10, wherein the at least one catch comprises a first catch extending outwardly from a first side wall of the first member and a second catch extending outwardly from a second side wall, and wherein the at least one recess of the seat or lid includes a first recess that is configured to receive the first catch and a second recess that opposes the first recess and is configured to receive the second catch.

12. The toilet or bidet attachment of claim 11, wherein the first member includes a hollow portion provided between the first and second side walls to allow the first and second side walls to be moved toward one another to move the first and second catches inwardly to allow the bumper assembly to be inserted into the pocket.

13. The toilet or bidet attachment of claim 12, wherein each side wall includes at least one transition having a reduced thickness relative to the adjacent section of the side wall to influence the deformability of the first member.

14. The toilet or bidet attachment of claim 13, wherein each side wall includes a transition having a reduced thickness provided near each end of the side wall.

15. The toilet or bidet attachment of claim 10, wherein one of the first and second members includes at least one projection extending outwardly from an outer surface thereof, and the other of the first and second members includes at least one pocket that is configured to receive the at least one projection to provide a mechanical lock coupling the first and second members together.

16. A method for making an attachment for a toilet or bidet, the method comprising:

forming a bumper assembly including a first member and a second member, where the second member comprises a resilient material and the first member comprises a relatively rigid material compared to the resilient material, the first member including a catch; and inserting the bumper assembly into a pocket defined by an inner wall of a projection of a seat or a lid of the toilet or bidet attachment, until the first member and the second member engage the pocket and the catch engages a recess provided in the inner wall to secure the bumper assembly to the seat or the lid, wherein the recess is an undercut in the inner wall that defines the pocket;

wherein the resilient second member is configured to contact a structure of the toilet or bidet underlying the toilet or bidet attachment, such that none of the first member, the seat or the lid, or the projection are configured to contact the underlying structure when the second member contacts the underlying structure.

17. The method of claim 16, wherein the relatively rigid material of the first member is a polymeric material, and the resilient material of the second member is an elastomeric material that is molded onto the first member.

18. The method of claim 17, wherein the first member includes a hollow portion provided between two side walls to allow the first member to deform to move the catch to fit into the pocket.

19. The method of claim 18, wherein the first member includes at least two catches with at least one catch provided on each of the two side walls, and wherein the first member is deformable to move the at least two catches to fit within the pocket until the catches are adjacent to a pair of recesses, which allows the catches to expand to engage the recesses.

20. The method of claim 19, wherein the shape and size of the resilient second member complements the shape and size of an opening of the pocket, such that the resilient second member forms a seal with the inner wall of the projection of the seat or the lid in order to prohibit the ingress of fluid into the pocket.

* * * * *